US011605914B2

(12) United States Patent
Fernandes

(10) Patent No.: US 11,605,914 B2
(45) Date of Patent: Mar. 14, 2023

(54) ELECTRICAL CONTACT WITH MULTIPLE CONTACT POINTS HAVING EQUIVALENT NORMAL FORCE

(71) Applicant: TE Connectivity Services GmbH, Schaffhausen (CH)

(72) Inventor: Stanrich D. Fernandes, Harrisburg, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/232,392

(22) Filed: Apr. 16, 2021

(65) Prior Publication Data

US 2021/0351534 A1 Nov. 11, 2021

Related U.S. Application Data

(60) Provisional application No. 63/020,289, filed on May 5, 2020.

(51) Int. Cl.

| | |
|---|---|
| ***H01R 13/15*** | (2006.01) |
| ***H01R 12/71*** | (2011.01) |
| ***H01R 13/24*** | (2006.01) |
| ***H01R 13/115*** | (2006.01) |

(52) U.S. Cl.

CPC ..... *H01R 13/15* (2013.01); *H01R 12/714* (2013.01); *H01R 13/115* (2013.01); *H01R 13/2457* (2013.01); *H01R 13/2492* (2013.01)

(58) Field of Classification Search

CPC .. H01R 13/15; H01R 12/714; H01R 13/2457; H01R 12/58; H01R 12/718; H01R 13/2492; H01R 13/113; H01R 13/2407; H01R 4/186; H01R 13/696; H01R 13/187; H01R 13/04; H01R 13/05; H01R 13/10; H01R 13/114; H01R 13/115

See application file for complete search history.

(56) References Cited

U.S. PATENT DOCUMENTS

| | | | | |
|---|---|---|---|---|
| 3,605,071 A * | 9/1971 | Sedlacek | ..... | H01R 4/2425 439/402 |
| 5,462,459 A * | 10/1995 | Childs | ..... | H01R 13/113 439/856 |
| 6,102,754 A * | 8/2000 | Capper | ..... | H01R 13/113 439/857 |

(Continued)

FOREIGN PATENT DOCUMENTS

| | | | | |
|---|---|---|---|---|
| CN | 1526185 A * | 9/2004 | ..... | H01R 12/7088 |
| CN | 203774394 U | 8/2014 | | |

(Continued)

OTHER PUBLICATIONS

Office Action for Chinese Patent Application No. 202110467170.0 dated Apr. 27, 2022 (English translation).

*Primary Examiner* — Travis S Chambers

(57) ABSTRACT

An electrical connector includes a mating section for receiving the mating tab therein. The mating section has a first contact arm and a second contact arm. The first contact arm is spaced from the second contact arm by a first slot. The first contact arm has a first length which is different than a second length of the second contact arm. A first normal force exerted by the first contact arm on the mating tab is equal to a second normal force exerted by the second contact arm.

19 Claims, 9 Drawing Sheets

(56) References Cited

U.S. PATENT DOCUMENTS

| | | | |
|---|---|---|---|
| 6,511,336 | B1 | 1/2003 | Turek et al. |
| 2012/0315804 | A1 | 12/2012 | Wang et al. |

FOREIGN PATENT DOCUMENTS

| | | | | |
|---|---|---|---|---|
| CN | 105846200 | A | 8/2016 | |
| CN | 208939185 | U | 6/2019 | |
| CN | 110416779 | A | 11/2019 | |
| CN | 210350186 | U | 4/2020 | |
| DE | 10331229 | A1 * | 1/2005 | ..... H01M 2/20 |
| DE | 10331229 | A1 | 1/2005 | |
| DE | 102016104868 | B3 * | 5/2017 | |

* cited by examiner

ELECTRICAL CONTACT WITH MULTIPLE CONTACT POINTS HAVING EQUIVALENT NORMAL FORCE

FIELD OF THE INVENTION

The invention is directed to an electrical contact which has multiple contact points having equivalent normal force. The invention is also directed to an electrical contact which can receive a mating tab from multiple directions.

BACKGROUND OF THE INVENTION

Contacts with multiple contact points are beneficial to provide redundant contact points to ensure that an electrical connection is made and retained between the contact and a mating contact. Multiple contact points also facilitate the transfer of high current between the contact and the mating contact. While multiple contacts are provided, each of the contact points have different normal forces. Consequently, as the contact is mated and unmated over many cycles, the wear at each contact point varies, causing each of the contact points to have different electrical characteristics. This causes the electrical current to flow unevenly across the contact points, which can lead to poor performance of the contacts.

Contacts are generally configured to mate with a mating contact in one direction. However, in certain applications, it may be beneficial to allow the mating contact to be inserted into the contact from different directions.

SUMMARY OF THE INVENTION

The following provides a summary of certain illustrative embodiments of the present invention. This summary is not an extensive overview and is not intended to identify key or critical aspects or elements of the present invention or to delineate its scope.

It is desired to provide a lance receiving recess in a contact receiving passageway which overcomes the problems of the prior art. It would, therefore, be beneficial to provide an electrical contact which has multiple contact points having equivalent normal force. It would also be beneficial to provide an electrical contact which can receive a mating tab from multiple directions.

An embodiment is directed to an electrical connector for receiving a mating tab. The electrical connector has a mating section for receiving the mating tab therein. The mating section has a first contact arm and a second contact engagement arm. The first contact engagement arm is spaced from the second contact engagement arm by a first slot. The first contact arm has a first length which is different than a second length of the second contact arm. A first normal force exerted by the first contact arm on the mating tab is equal to a second normal force exerted by the second contact arm.

An embodiment is directed to an electrical connector for receiving a mating tab. The electrical connector includes a mating section for receiving the mating tab therein. The mating section has a base section with a mating section first wall and a mating section second wall. A first mating contact engagement section extends from the mating section first wall and a second mating contact engagement section extends from the mating section second wall. The first mating contact engagement section and the second mating contact have first contact arms and second contact engagement arms. The first contact engagement arms are spaced from the second contact engagement arms by first slots. The first contact arms have a first length which is different than a second length of the second contact arms. A first normal force exerted by the first contact arms on the mating tab is equal to a second normal force exerted by the second contact arms.

The first mating contact engagement section and the second mating contact may have third contact engagement arms. The second contact engagement arms are spaced from the third contact engagement arms by second slots. The third contact arms have a third length which is different than the first length of the first contact arms and the second length of the second contact arms. The first slots have a first slot length which is different than the second slot length of the second slots. A third normal force exerted by the third contact arms on the mating tab is equal to the first normal force exerted by the first contact arms and the second normal force exerted by the second contact arms.

An embodiment is directed to an electrical connector for receiving a mating tab from multiple directions. The electrical connector includes a mounting section for mounting to a substrate or a mating connector and a mating section for receiving the mating tab therein. The mating section has a base section with a first wall and a second wall. A first mating contact engagement section extends from the first wall and a second mating contact engagement section extends from the second wall. The first mating contact engagement section and the second mating contact engagement section have contact arms with first lead-in surfaces provided at free ends thereof. A tab receiving slot extends between the first wall and the second wall of the base section and continues between the first mating contact engagement section and the second mating contact engagement section. A second lead-in surface extends from a mating surface of the mating section, the lead-in surface extends across the base section, the first mating contact engagement section and the second mating contact engagement section. The first lead-in surfaces and the second lead-in surface allows the mating tab to be inserted into the tab receiving slot from multiple directions.

Additional features and aspects of the present invention will become apparent to those of ordinary skill in the art upon reading and understanding the following detailed description of the illustrative embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more illustrative embodiments of the invention and, together with the general description given above and detailed description given below, serve to explain the principles of the invention, and wherein.

DETAILED DESCRIPTION OF THE INVENTION

Figure 1:
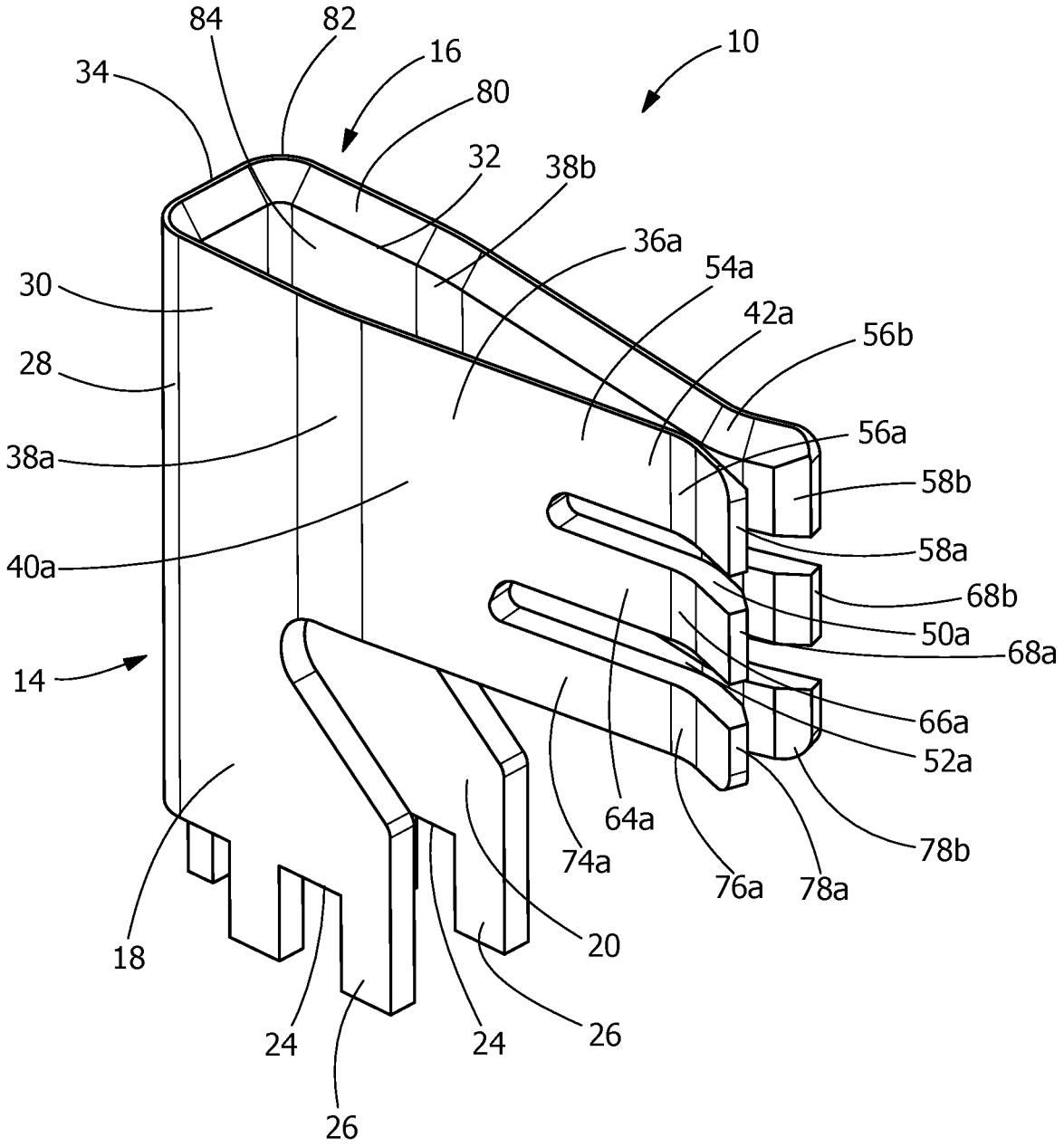
FIG. 1 is a perspective view of an illustrative embodiment of an electrical contact according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Illustrative embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

An illustrative electrical contact 10, according to the present invention is shown in FIGS. 1 through 7. The contact 10 has a mounting section 14 and a tab mating section 16.

Figure 4:
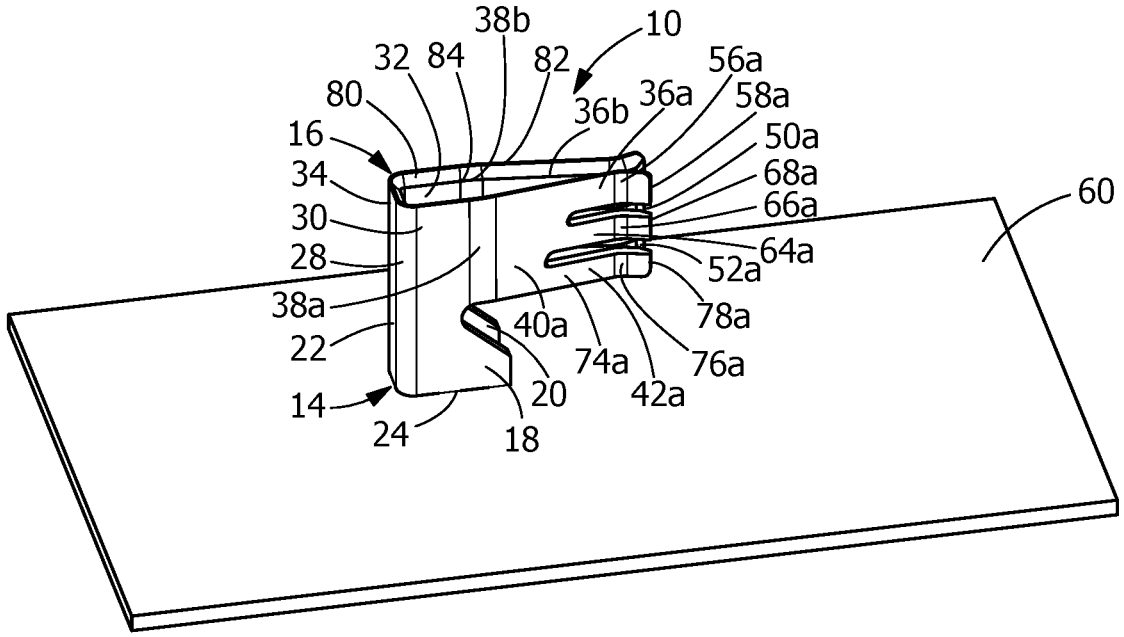
FIG. 4 is a perspective view of the electrical contact of FIG. 1 mounted to a substrate.

In the illustrative embodiment shown, the mounting section 14 is general U-shaped configuration with a mounting section first wall 18, a mounting section second wall 20 which is spaced from the mounting section first wall 18, and a mounting section third wall 22 which extends between the mounting section first wall 18 and the mounting section second wall 20. The mounting section 14 has a substrate engagement surface 24 with mounting legs 26 which extend therefrom in a direction away from the mating section 16. In the illustrative embodiment shown, the mounting legs 26 are configured to be inserted into through holes (not shown) of a substrate 20 (FIG. 4). While the illustrative mounting section 14 is shown in the figures, the mounting section 14 may have different configurations, including, but not limited to, a receptacle contact section, a pin contact section or a crimp section.

The mating section 16 extends from the mounting section 14. In the illustrative embodiment shown, the mating section 16 extends in a direction away from the mounting legs 26. The mating section 16 has a base section 28 with a mating section first wall 30, a mating section second wall 32 which is spaced from the mating section first wall 30, and a third wall mating section 34 which extends between the mating section first wall 30 and the mating section second wall 32.

As shown in FIG. 1, a first mating contact engagement section 36*a* of the mating section 16 extends from the first wall 30 in a direction away from the third wall 34. The first contact engagement section 36*a* has a first bend portion 38*a*, a first stabilizing portion 40*a*, and a first tab engaging portion 42*a*. The first bend portion 38*a* extends from and is integral with the first wall 30.

Figure 2:
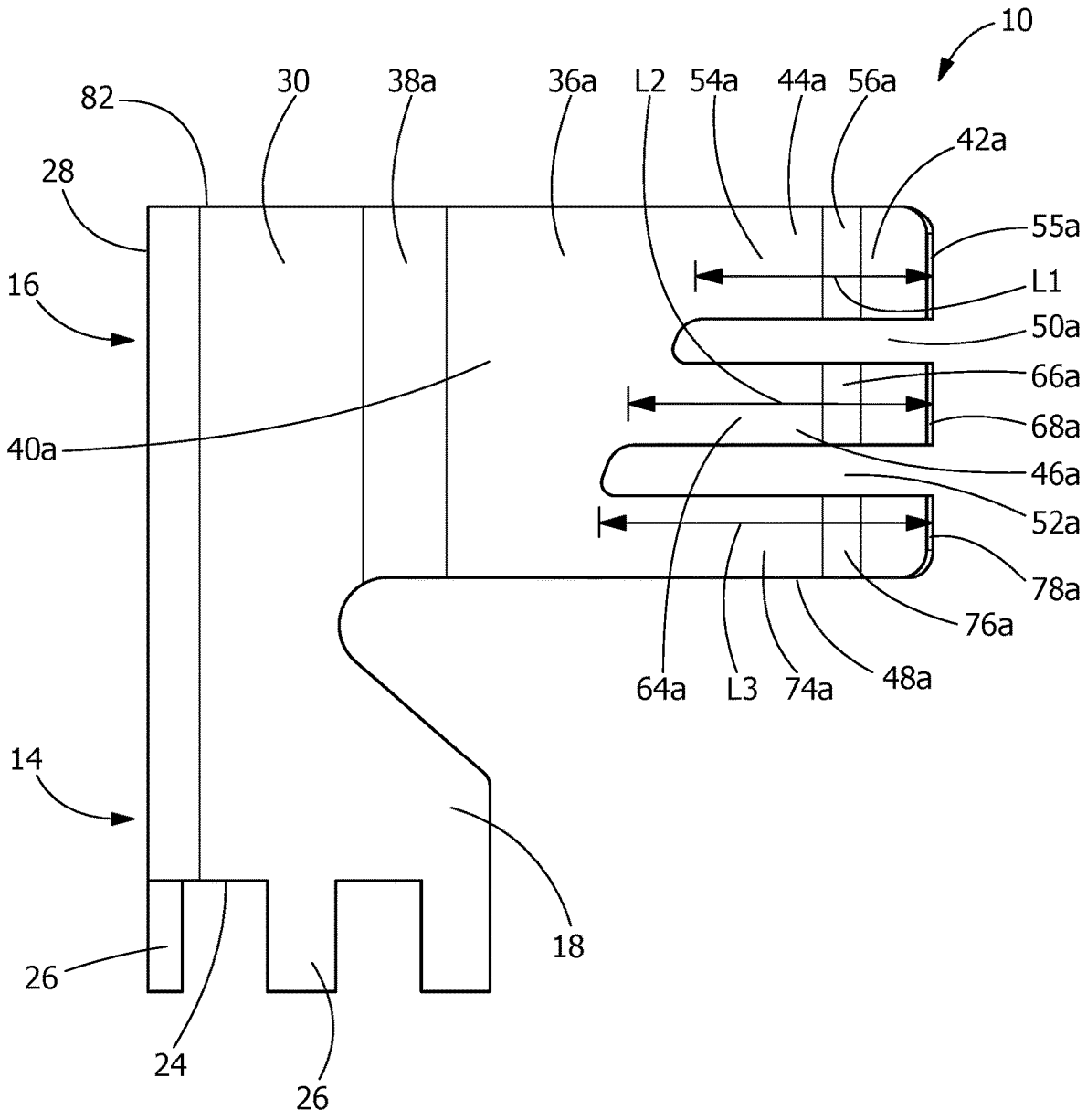
FIG. 2 is a plan view of a first side of the electrical contact of FIG. 1.

As shown in FIG. 2, the tab engaging portion 42*a* has a first resilient contact arm 44*a*, a resilient second contact arm 46*a* and a resilient third contact engagement arm 48*a*. Although three resilient contact arms 44*a*, 46*a*, 48*a* are provided, other numbers of contact arms may be used. The first resilient contact arm 44*a* is spaced from the second resilient contact arm 46*a* by a first slot 50*a*. The second resilient contact arm 46*a* is spaced from the third resilient contact arm 48*a* by a second slot 52*a*.

The first resilient contact arm 44*a* has a straight portion 54*a*, a contact portion 56*a* and a lead-in portion 58*a*. The first contact arm 44*a* extends from the stabilizing portion 40*a* and has a first length L1. The lead-in portion 58*a* is provided at a free end of the first contact arm 44*a* which is spaced from the stabilizing portion 40*a*. The contact portion 56*a* is provided between the straight portion 54*a* and the lead-in portion 58*a*. The contact portion 56*a* has a curved configuration.

The second resilient contact arm 46*a* has a straight portion 64*a*, a contact portion 66*a* and a lead-in portion 68*a*. The second contact arm 46*a* extends from the stabilizing portion 40*a* and has a second length L2. The lead-in portion 68*a* is provided at a free end of the second contact arm 46*a* which is spaced from the stabilizing portion 40*a*. The contact portion 66*a* is provided between the straight portion 64*a* and the lead-in portion 68*a*. The contact portion 66*a* has a curved configuration.

The third resilient contact arm 48*a* has a straight portion 74*a*, a contact portion 76*a* and a lead-in portion 78*a*. The third contact arm 48*a* extends from the stabilizing portion 40*a* and has a third length L3. The lead-in portion 78*a* is provided at a free end of the third contact arm 48*a* which is spaced from the stabilizing portion 40*a*. The contact portion 76*a* is provided between the straight portion 74*a* and the lead-in portion 78*a*. The contact portion 76*a* has a curved configuration.

Figure 3:
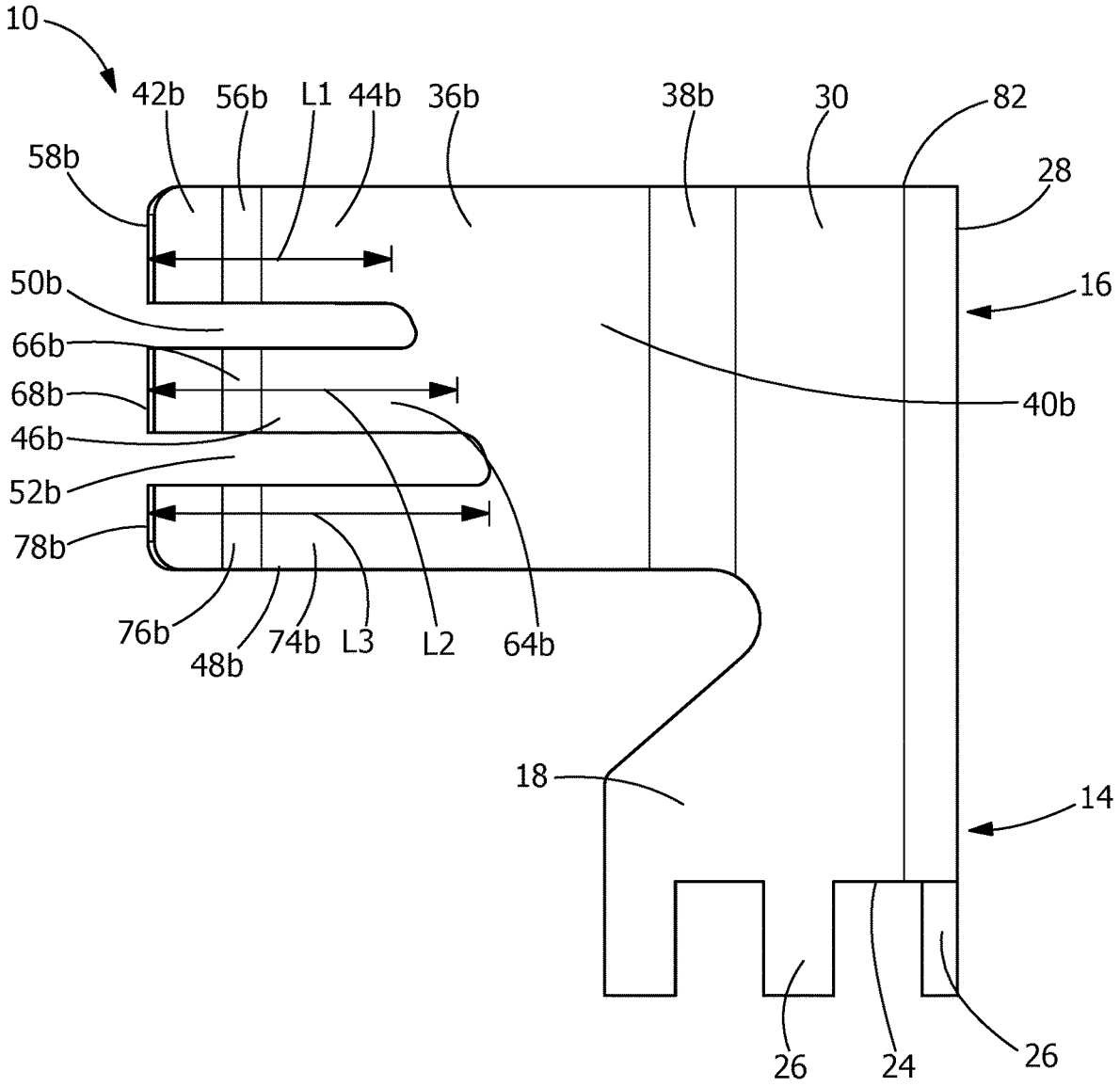
FIG. 3 is a plan view of a second side of the electrical contact of FIG. 1.

As shown in FIG. 1, a second mating contact engagement section 36*b* of the mating section 16 extends from the second wall 32 in a direction away from the third wall 34. As shown in FIG. 3, the second mating contact engagement section 36*b* is a mirror image of the first contact engagement section

36*a*. The second contact engagement section 36*b* has a second bend portion 38*b*, a second stabilizing portion 40*b*, and a second tab engaging portion 42*b*. The second bend portion 38*b* extends from and is integral with the second wall 32.

As shown in FIG. 3, the tab engaging portion 42*b* has a first resilient contact arm 44*a*, a second resilient contact arm 46*b* and a third resilient contact arm 48*b*. Although three contact arms 44*b*, 46*b*, 48*b* are provided, other numbers of contact arms may be used. The first resilient contact arm 44*b* is spaced from the second resilient contact arm 46*b* by a first slot 50*b*. The second resilient contact arm 46*b* is spaced from the third resilient contact arm 48*b* by a second slot 52*b*.

The first resilient contact arm 44*b* has a straight portion 54*b*, a contact portion 56*b* and a lead-in portion 58*b*. The first contact arm 44*b* extends from the stabilizing portion 40*b* and has a first length L1. The lead-in portion 58*b* is provided at a free end of the first contact arm 44*b* which is spaced from the stabilizing portion 40*b*. The contact portion 56*b* is provided between the straight portion 54*b* and the lead-in portion 58*b*. The contact portion 56*b* has a curved configuration.

The second resilient contact arm 46*b* has a straight portion 64*b*, a contact portion 66*b* and a lead-in portion 68*b*. The second contact arm 46*b* extends from the stabilizing portion 40*b* and has a second length L2. The lead-in portion 68*b* is provided at a free end of the second contact arm 46*b* which is spaced from the stabilizing portion 40*b*. The contact portion 66*b* is provided between the straight portion 64*b* and the lead-in portion 68*b*. The contact portion 66*b* has a curved configuration.

The third resilient contact arm 48*b* has a straight portion 74*b*, a contact portion 76*b* and a lead-in portion 78*b*. The third contact arm 48*b* extends from the stabilizing portion 40*b* and has a third length L3. The lead-in portion 78*b* is provided at a free end of the first contact arm 48*b* which is spaced from the stabilizing portion 40*b*. The contact portion 76*b* is provided between the straight portion 74*b* and the lead-in portion 78*b*. The contact portion 76*b* has a curved configuration.

As shown in FIG. 1, a tab receiving slot 84 extends between the first wall 30 and the second wall 32 of the first mating section 16. The tab receiving slot 84 continues between the first mating contact engagement section 36*a* and the second mating contact engagement section 36*b*. The tab receiving slot 84 has a sloped or lead-in surface 80 which extends from a mating surface 82 of the mating section 16. The lead-in surface 80 extends across the base section 28, the first mating contact engagement section 36*a* and the second mating contact engagement section 36*b*.

Figure 5:
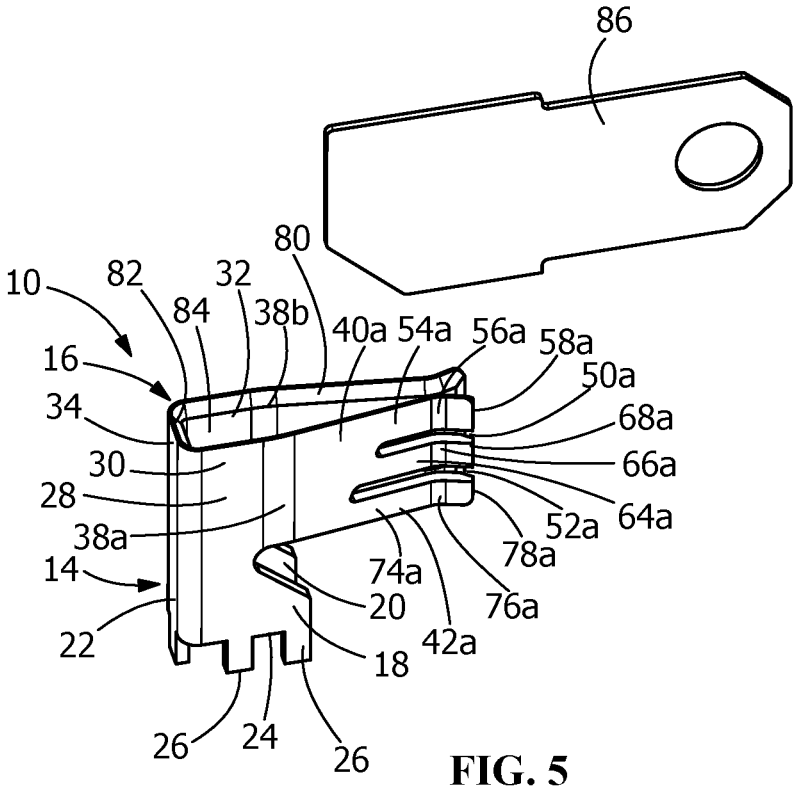
FIG. 5 is a perspective view of the electrical contact of FIG. 1 with a mating tab positioned above the electrical contact.
Figure 6:
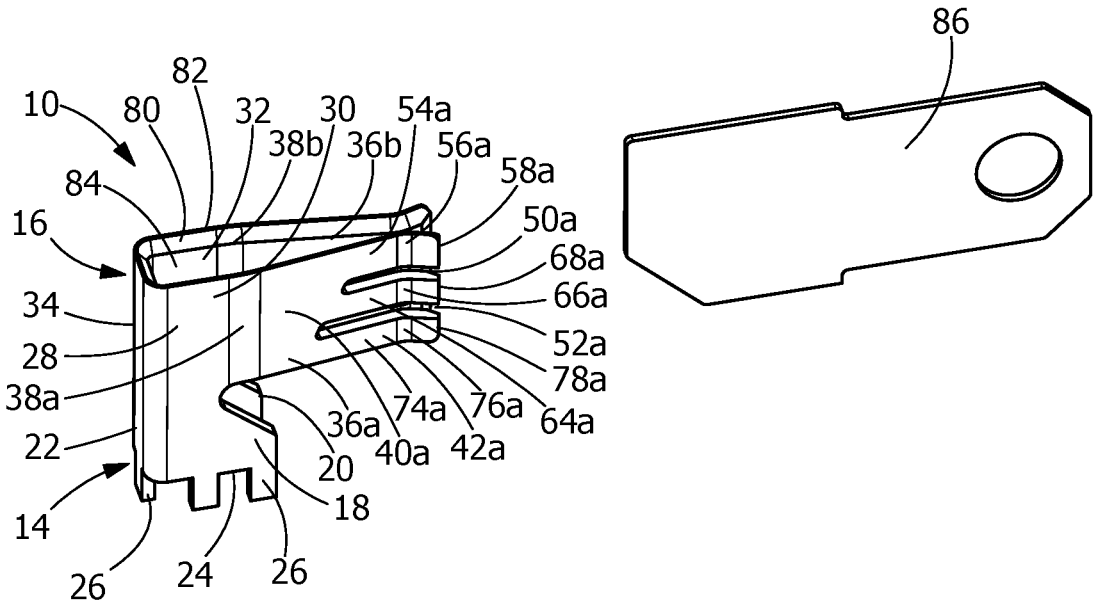
FIG. 6 is a perspective view of the electrical contact of FIG. 1 with a mating tab positioned adjacent the electrical contact.
Figure 7:
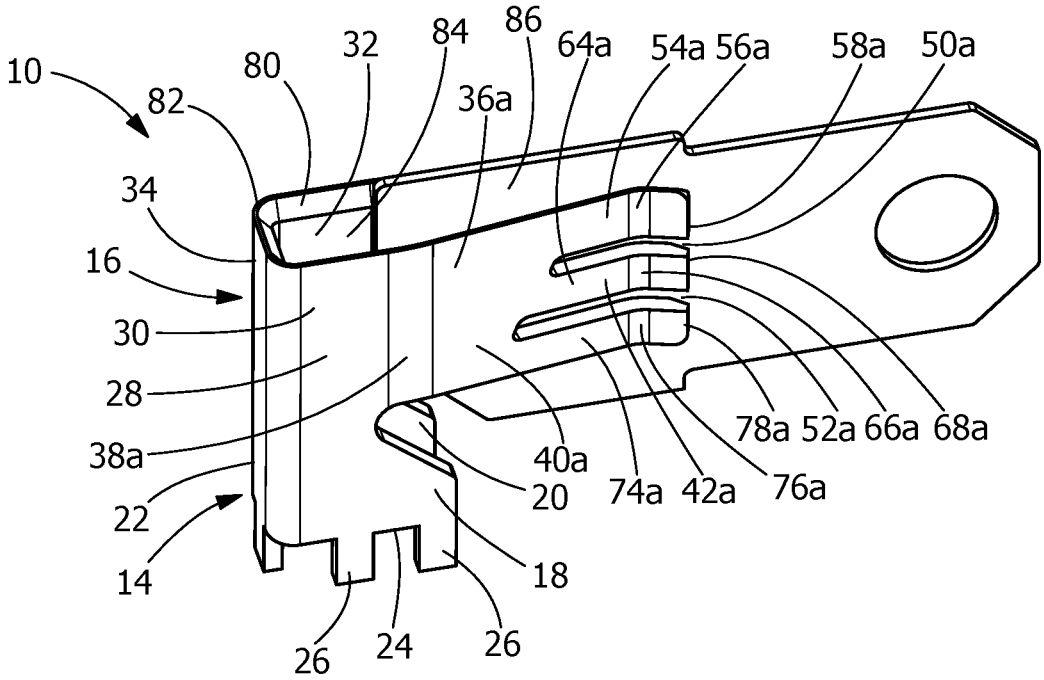
FIG. 7 is a perspective view of the electrical contact of FIG. 1 with a mating tab inserted into the electrical contact.

When in use, in the illustrative the mounting section 14 of the electrical contact 10 is mounted to a printed circuit board 60, as shown in FIG. 4. With the electrical contact 10 properly mounted, the tab 86 may be moved into electrical engagement with the mating section 16 of the electrical contact 10 from the top, as shown in FIG. 5 or from the side, as shown FIG. 6.

When inserted from the top (FIG. 5), the tab 86 is inserted into the tab receiving slot 84 through the mating surface 82. As the tab 86 is inserted, the tab 86 engages the sloped or lead-in surface 80 which facilitates the positioning of the tab 86 into the tab receiving slot 84. As the tab 86 is inserted, the tab 86 initially engages the contact portions 56*a*, 56*b* of the first resilient contact arms 44*a*, 44*b*. As insertion continues, the tab 86 engages the contact portions 66*a*, 66*b* of the second resilient contact arms 46*a*, 46*b* and then the third contact portions 76*a*, 76*b* of the third resilient contact arms 48*a*, 48*b*.

With the tab 86 fully inserted from the top, the mating section 16 of the electrical contact 10 is positioned in mechanical and electrical engagement with tab 86 at the contact portions 56*a*, 56*b* of the first resilient contact arms 44*a*, 44*b*, the contact portions 66*a*, 66*b* of the second resilient contact arms 46*a*, 46*b* and the third contact portions 76*a*, 76*b* of the third resilient contact arms 48*a*, 48*b*. This provides six points of contact between the electrical contact 10 and the tab 86, allowing high and even current flow therebetween.

Figure 8:
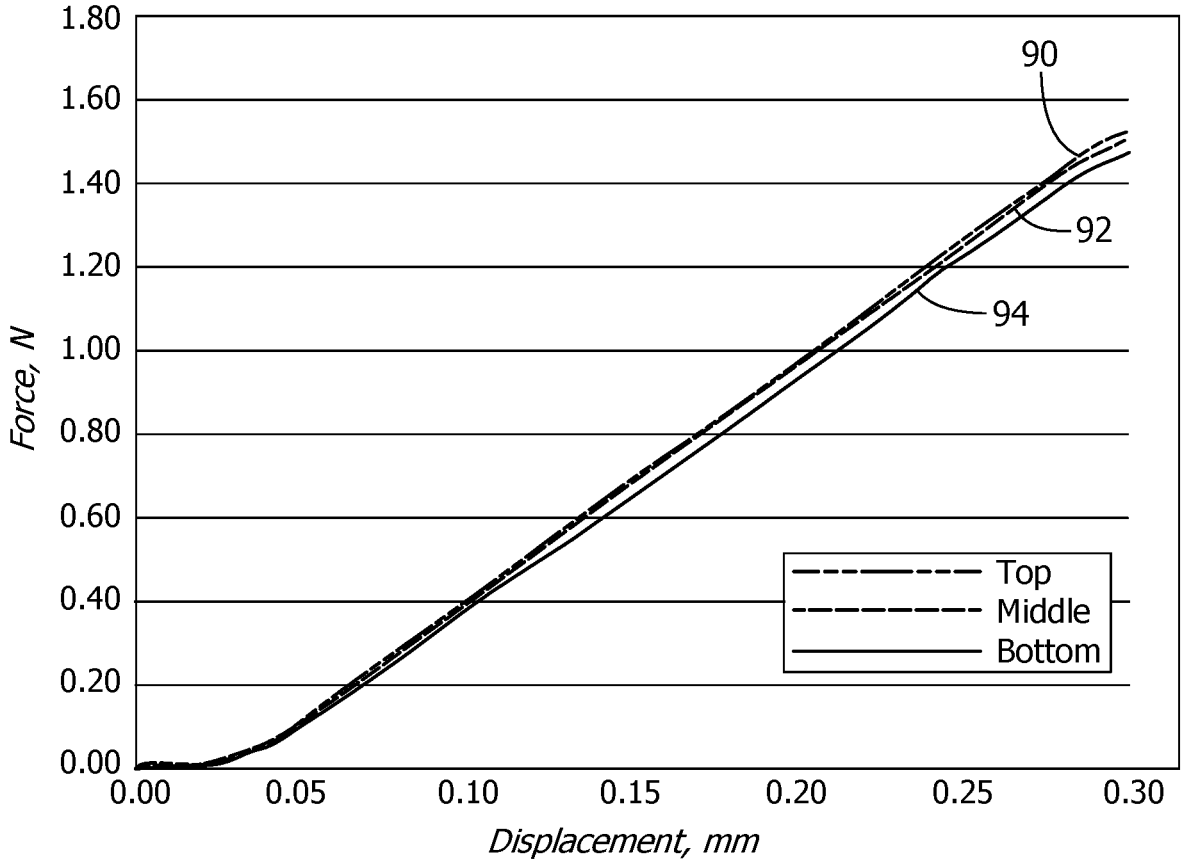
FIG. 8 is a graph of illustrative normal forces at the contact points of the electrical contact versus displacement of the contact arms of the electrical contact.

As shown in FIG. 8, the normal force in newtons of each of the contact arms is plotted against the displacement in millimeters. Curve 90 represent the normal force of contact arms 44*a*, 44*b*, curve 92 represent the normal force of contact arms 46*a*, 46*b*, and curve 94 represent the normal force of contact arms 48*a*, 48*b*. Because of the configuration of the resilient contact arms 44*a*, 44*b*, 46*a*, 46*b*, 48*a*, 48*b*, the normal force applied by the contact portions 56*a*, 56*b* of the first resilient contact arms 44*a*, 44*b* to the tab 86 (as shown by 90 in FIG. 8) is essentially equivalent to the normal force applied by the contact portions 66*a*, 66*b* of the second resilient contact arms 46*a*, 46*b* (as shown by 92 in FIG. 8) and is essentially equivalent to the normal force applied by the contact portions 76*a*, 76*b* of the third resilient contact arms 48*a*, 48*b* (as shown by 94 in FIG. 8). As the first resilient contact arms 44*a*, 44*b* are surrounded by less material at the stabilizing portions 40*a*, 40*b*, the first resilient contact arms 44*a*, 44*b* have a shorter length L1 to obtain the desired normal force. As the third resilient contact arms 48*a*, 48*b* are surrounded by more material at the stabilizing portions 40*a*, 40*b*, the third resilient contact arms 48*a*, 48*b* have a longer length L3 to obtain the desired normal force.

When inserted from the side (FIG. 6), the tab 86 is inserted into the tab receiving slot 84 through the free ends of the resilient contact arms 44*a*, 44*b*, 46*a*, 46*b*, 48*a*, 48*b*. As the tab 86 is inserted, the tab 86 engages the lead-in surfaces 58*a*, 58*b*, 68*a*, 68*b*, 78*a*, 78*b* which facilitates the positioning of the tab 86 into the tab receiving slot 84.

With the tab 86 fully inserted from the side, the mating section 16 of the electrical contact 10 is positioned in mechanical and electrical engagement with tab 86 at the contact portions 56*a*, 56*b* of the first resilient contact arms 44*a*, 44*b*, the contact portions 66*a*, 66*b* of the second resilient contact arms 46*a*, 46*b* and the third contact portions 76*a*, 76*b* of the third resilient contact arms 48*a*, 48*b*. This provides six points of contact between the electrical contact 10 and the tab 86, allowing high and even current flow therebetween.

Because of the configuration of the resilient contact arms 44*a*, 44*b*, 46*a*, 46*b*, 48*a*, 48*b*, the normal force applied by the contact portions 56*a*, 56*b* of the first resilient contact arms 44*a*, 44*b* to the tab 86 (as shown by 90 in FIG. 8) is essentially equivalent to the normal force applied by the contact portions 66*a*, 66*b* of the second resilient contact arms 46*a*, 46*b* (as shown by 92 in FIG. 8) and is essentially equivalent to the normal force applied by the contact portions 76*a*, 76*b* of the third resilient contact arms 48*a*, 48*b* (as shown by 94 in FIG. 8). As the first resilient contact arms 44*a*, 44*b* are surrounded by less material at the stabilizing portions 40*a*, 40*b*, the first resilient contact arms 44*a*, 44*b* have a shorter length L1 to obtain the desired normal force. As the third resilient contact arms 48*a*, 48*b* are surrounded by more material at the stabilizing portions 40*a*, 40*b*, the third resilient contact arms 48*a*, 48*b* have a longer length L3 to obtain the desired normal force.

As the normal force at all points of contact is essentially identical, each of the contact portions 56*a*, 56*b*, 66*a*, 66*b*, 76*a*, 76*b* will have the same amount of wear as the tab 86 is inserted and removed from the electrical contact 10 over many cycles. As the contact portions 56*a*, 56*b*, 66*a*, 66*b*, 76*a*, 76*b* apply the same normal force on the tab and as the contact portions 56*a*, 56*b*, 66*a*, 66*b*, 76*a*, 76*b*, will have the same amount of wear, the flow of the electrical current over the life of the electrical contact 10 will remain evenly distributed, as electrical connection between each of the contact portions 56*a*, 56*b*, 66*a*, 66*b*, 76*a*, 76*b* and the tab 86 will remain consistent with the other contact portions 56*a*, 56*b*, 66*a*, 66*b*, 76*a*, 76*b*.

Having multiple contact portions 56*a*, 56*b*, 66*a*, 66*b*, 76*a*, 76*b*, with essentially equivalent contact or normal forces allows the current to flow evenly between the contact portions 56*a*, 56*b*, 66*a*, 66*b*, 76*a*, 76*b*, and the tab 86. The even flow of current prevents any one contact portion 56*a*, 56*b*, 66*a*, 66*b*, 76*a*, 76*b*, from overheating due to excess current flow. Consequently, the configuration of the resilient contact arms 44*a*, 44*b*, 46*a*, 46*b*, 48*a*, 48*b* to control and make equal the normal force at all points of contact allows for the maximum temperature rise for the contact 10 to be controlled and reduced.

Figure 9:
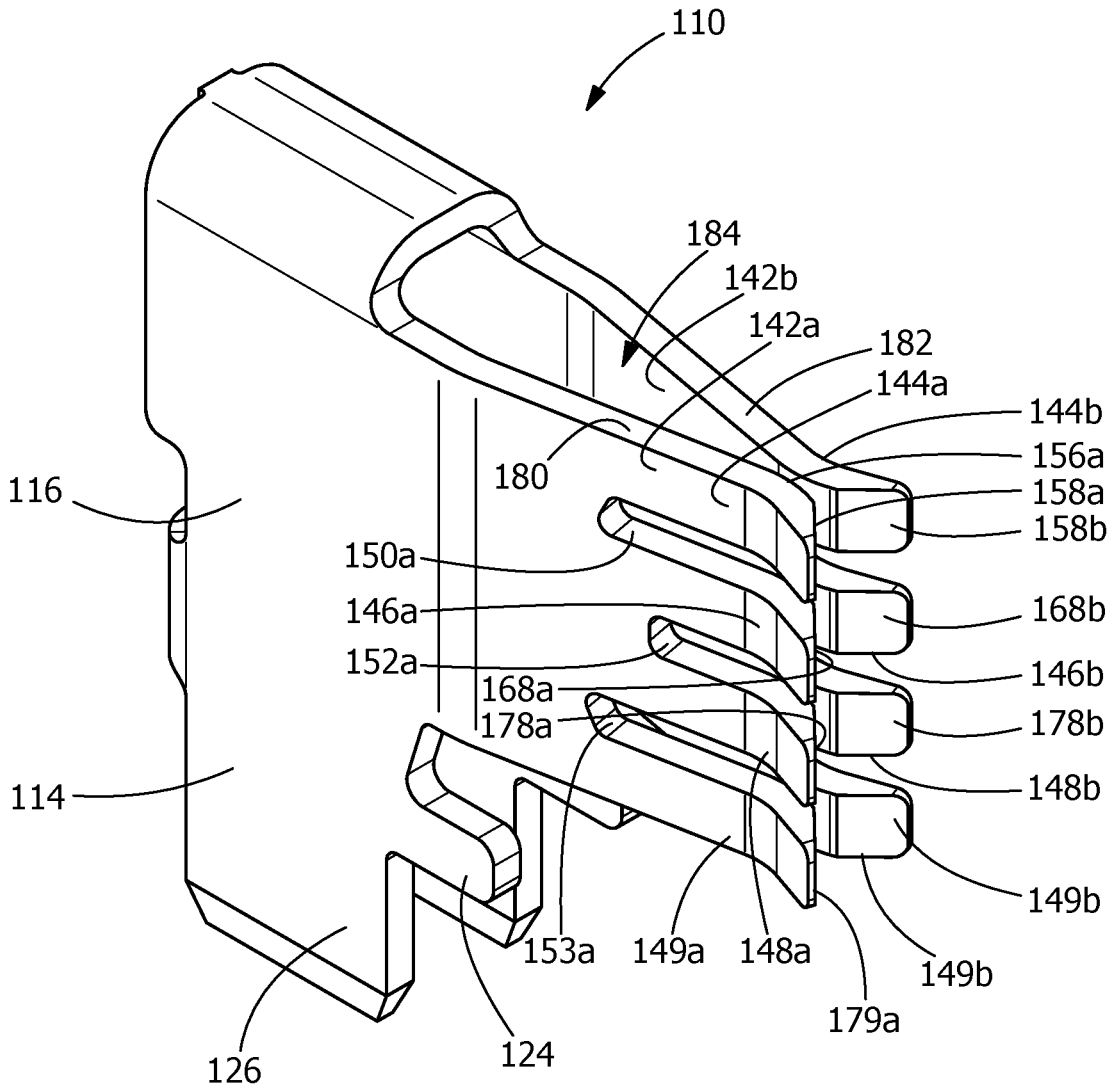
FIG. 9 is a perspective view of an alternate illustrative embodiment of an electrical contact according to the present invention.
Figure 10:
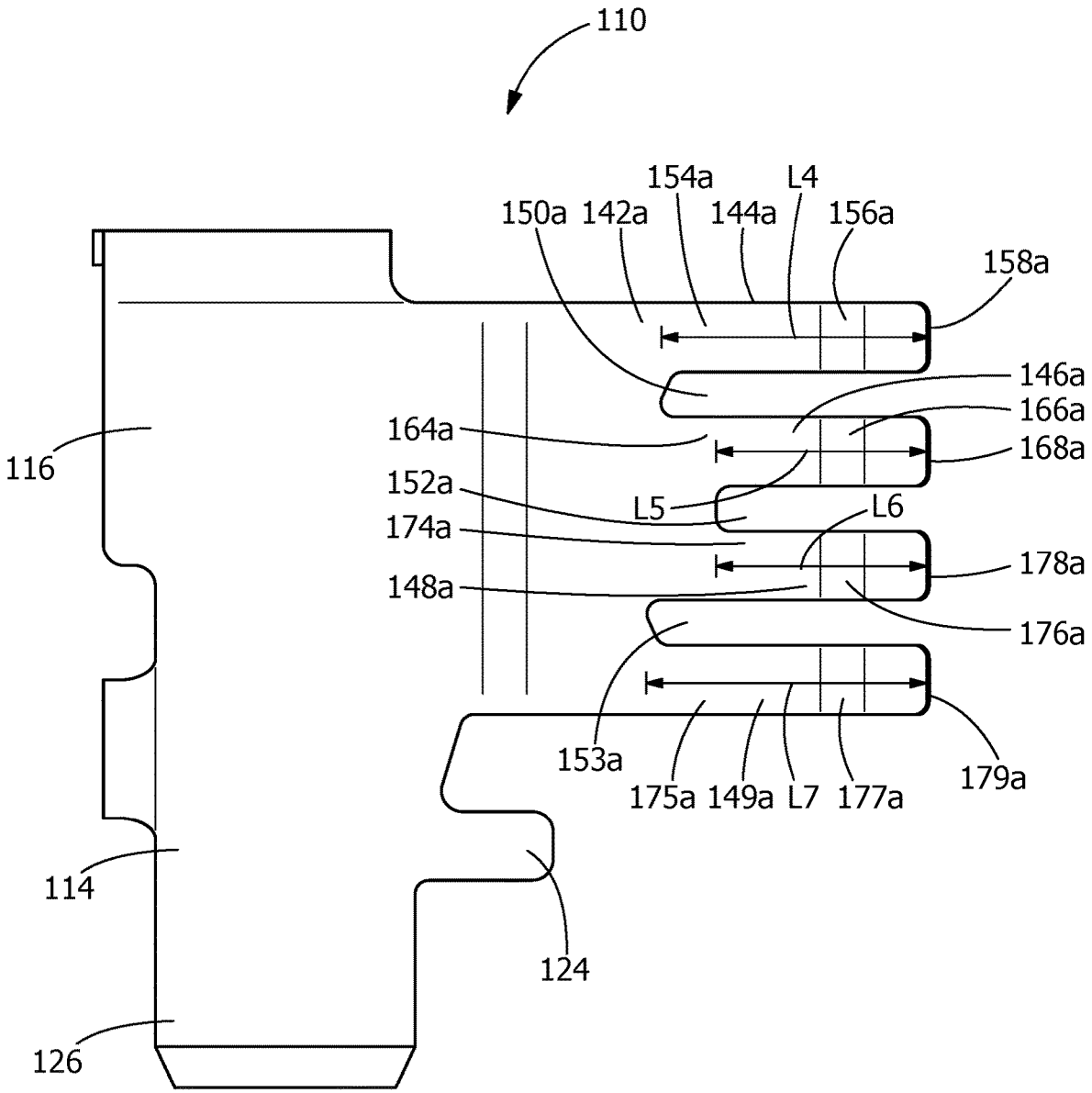
FIG. 10 is a plan view of a first side of the electrical contact of FIG. 9.
Figure 11:
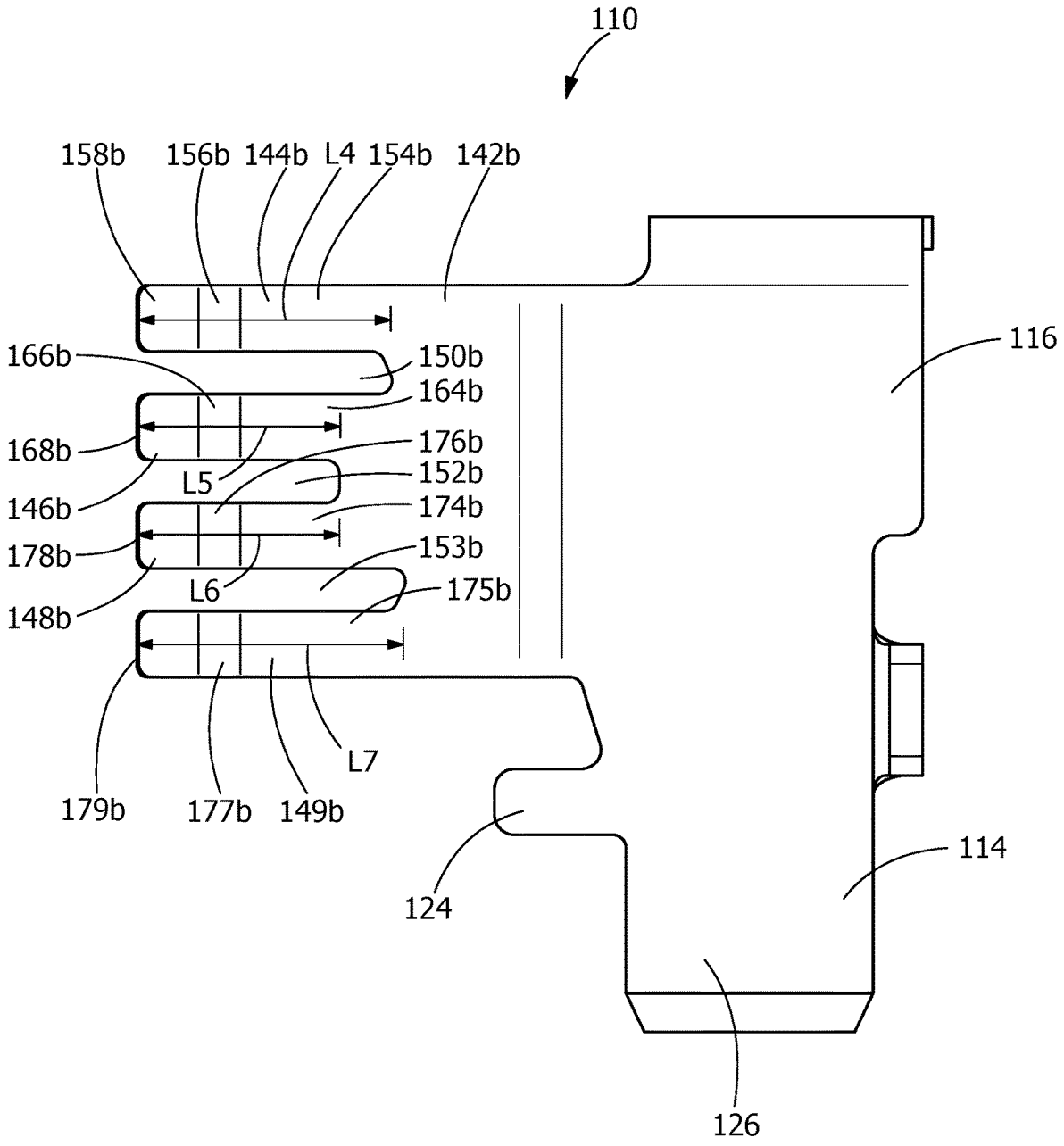
FIG. 11 is a plan view of a second side of the electrical contact of FIG. 9.

An alternate illustrative electrical contact 110, according to the present invention is shown in FIGS. 9 through 11. The contact 110 has a mounting section 114 and a tab mating section 116. The mounting section 114 and the tab mating section 116 are similar the mounting section 14 and the tab mating section 16 except for the differences described below.

The mounting section 114 has substrate engagement projections 124 with mounting tabs 126 which past the substrate engagement projections 124 in a direction away from the mating section 116. In the illustrative embodiment shown, the mounting tabs 126 are configured to be inserted into through holes (not shown) of a substrate (not shown). The substrate engagement projections 124 engage the substrate to limit the insertion of the mounting tabs 126 in the through holes. The substrate engagement projections 124 also engage the substrate to help stabilize the contact 110 on the substrate. Other configurations of the mounting section 114 may be used.

As shown in FIG. 10, the tab engaging portion 142*a* has a first resilient contact 144*a*, a resilient second contact arm 146*a*, a resilient third contact arm 148*a* and a fourth contact arm 149*a*. Although the first resilient contact arm 144*a*, the resilient second contact arm 146*a* and the resilient third contact arm 148*a* have different lengths than the first resilient contact arm 44*a*, the resilient second contact arm 46*a* and the resilient third contact arm 48*a*, the operate in the same manner.

The first resilient contact arm 144*a* is spaced from the second resilient contact arm 146*a* by a first slot 150*a*. The second resilient contact arm 146*a* is spaced from the third resilient contact arm 148*a* by a second slot 152*a*. The third resilient contact arm 148*a* is spaced from the fourth resilient contact arm 149*a* by a third slot 153*a*.

The first resilient contact arm 144*a* has a straight portion 154*a*, a contact portion 156*a* and a lead-in portion 158*a*. The first contact arm 144*a* extends from the stabilizing portion 140*a* and has a first length L4. The lead-in portion 158*a* is provided at a free end of the first contact arm 144*a* which is spaced from the stabilizing portion 140*a*. The contact portion 156*a* is provided between the straight portion 154*a* and the lead-in portion 158*a*. The contact portion 156*a* has a curved configuration.

The second resilient contact arm 146*a* has a straight portion 164*a*, a contact portion 166*a* and a lead-in portion 168*a*. The second contact arm 146*a* extends from the stabilizing portion 140*a* and has a second length L5. The lead-in portion 168*a* is provided at a free end of the second contact arm 146*a* which is spaced from the stabilizing portion 140*a*. The contact portion 166*a* is provided between the straight portion 164*a* and the lead-in portion 168*a*. The contact portion 166*a* has a curved configuration.

The third resilient contact arm 148*a* has a straight portion 174*a*, a contact portion 176*a* and a lead-in portion 178*a*. The third contact arm 148*a* extends from the stabilizing portion 140*a* and has a third length L6. The lead-in portion 178*a* is provided at a free end of the third contact arm 148*a* which is spaced from the stabilizing portion 140*a*. The contact portion 176*a* is provided between the straight portion 174*a* and the lead-in portion 178*a*. The contact portion 176*a* has a curved configuration.

The fourth resilient contact arm 149*a* has a straight portion 175*a*, a contact portion 177*a* and a lead-in portion 179*a*. The fourth contact arm 149*a* extends from the stabilizing portion 140*a* and has a third length L7. The lead-in portion 170*a* is provided at a free end of the fourth contact arm 149*a* which is spaced from the stabilizing portion 140*a*. The contact portion 177*a* is provided between the straight portion 175*a* and the lead-in portion 179*a*. The contact portion 177*a* has a curved configuration.

As shown in FIG. 11, the tab engaging portion 142*b* has a first resilient contact arm 144*a*, a second resilient contact arm 146*b*, a third resilient contact arm 148*b* and a fourth resilient contact arm 149*b*. The first resilient contact arm 144*b* is spaced from the second resilient contact arm 146*b* by a first slot 150*b*. The second resilient contact arm 146*b* is spaced from the third resilient contact arm 148*b* by a second slot 152*b*. The third resilient contact arm 148*b* is spaced from the fourth resilient contact arm 149*b* by a third slot 153*b*.

The first resilient contact arm 144*b* has a straight portion 154*b*, a contact portion 156*b* and a lead-in portion 158*b*. The first contact arm 144*b* extends from the stabilizing portion 140*b* and has a first length L4. The lead-in portion 158*b* is provided at a free end of the first contact arm 144*b* which is spaced from the stabilizing portion 140*b*. The contact portion 156*b* is provided between the straight portion 154*b* and the lead-in portion 158*b*. The contact portion 156*b* has a curved configuration.

The second resilient contact arm 146*b* has a straight portion 164*b*, a contact portion 166*b* and a lead-in portion 168*b*. The second contact arm 146*b* extends from the stabilizing portion 140*b* and has a second length L5. The lead-in portion 168*b* is provided at a free end of the second contact arm 146*b* which is spaced from the stabilizing portion 140*b*. The contact portion 166*b* is provided between the straight portion 164*b* and the lead-in portion 168*b*. The contact portion 166*b* has a curved configuration.

The third resilient contact arm 148*b* has a straight portion 174*b*, a contact portion 176*b* and a lead-in portion 178*b*. The third contact arm 148*b* extends from the stabilizing portion 140*b* and has a third length L6. The lead-in portion 178*b* is provided at a free end of the first contact arm 148*b* which is spaced from the stabilizing portion 140*b*. The contact portion 176*b* is provided between the straight portion 174*b* and the lead-in portion 178*b*. The contact portion 176*b* has a curved configuration.

The fourth resilient contact arm 149*b* has a straight portion 175*b*, a contact portion 177*b* and a lead-in portion 179*b*. The fourth contact arm 149*b* extends from the stabilizing portion 140*b* and has a third length L7. The lead-in portion 170*b* is provided at a free end of the fourth contact arm 149*b* which is spaced from the stabilizing portion 140*b*. The contact portion 177*b* is provided between the straight portion 175*b* and the lead-in portion 179*b*. The contact portion 177*b* has a curved configuration.

As shown in FIG. 9, a tab receiving slot 184 extends between the first wall 130 and the second wall 132 of the first mating section 116. The tab receiving slot 184 continues between the first mating contact engagement section 136*a* and the second mating contact engagement section 136*b*. The tab receiving slot 184 has a sloped or lead-in surface 180 which extends from a mating surface 182 of the mating section 116. The lead-in surface 180 extends across the base section 128, the first mating contact engagement section 136*a* and the second mating contact engagement section 136*b*.

When in use, in the illustrative the mounting section 114 of the electrical contact 10 is mounted to the substrate (not shown). With the electrical contact 110 properly mounted, the tab (similar to tab 86) may be moved into electrical engagement with the mating section 116 of the electrical contact 110 from the top.

When inserted from the top, the tab is inserted into the tab receiving slot 184 through the mating surface 182. As the tab is inserted, the tab engages the sloped or lead-in surface 180 which facilitates the positioning of the tab into the tab receiving slot 184. As the tab is inserted, the tab initially engages the contact portions 156*a*, 156*b* of the first resilient contact arms 144*a*, 144*b*. As insertion continues, the tab engages the contact portions 166*a*, 166*b* of the second resilient contact arms 146*a*, 146*b*, then the third contact portions 176*a*, 176*b* of the third resilient contact arms 148*a*, 148*b* and finally the fourth contact portions 177*a*, 177*b* of the fourth contact arms 147*a*, 147*b*.

With the tab fully inserted from the top, the mating section 116 of the electrical contact 110 is positioned in mechanical and electrical engagement with tab at the contact portions 156*a*, 156*b* of the first resilient contact arms 144*a*, 144*b*, the contact portions 166*a*, 166*b* of the second resilient contact arms 146*a*, 146*b*, the third contact portions 176*a*, 176*b* of the third resilient contact arms 148*a*, 148*b* and the fourth contact portions 177*a*, 177*b* of the fourth contact arms 147*a*, 147*b*. This provides eight points of contact between the electrical contact 110 and the tab, allowing high and even current flow therebetween.

As previously described with respect to FIGS. 1-8, and because of the configuration of the resilient contact arms 144*a*, 144*b*, 146*a*, 146*b*, 148*a*, 148*b*, 149*a*, 149*b*, the normal force applied by the contact portions 156*a*, 156*b* of the first resilient contact arms 144*a*, 144*b* to the tab is essentially equivalent to the normal force applied by the contact portions 166*a*, 166*b* of the second resilient contact arms 146*a*, 146*b*, is essentially equivalent to the normal force applied by the contact portions 176*a*, 176*b* of the third resilient contact arms 148*a*, 148*b*, and is essentially equivalent to the normal force applied by the contact portions 177*a*, 177*b* of the fourth resilient contact arms 149*a*, 149*b*.

In the illustrative embodiment shown, the length L5 of the second resilient contact arms 146*a*, 146*b* and the length L6 of the third resilient contact arms 148*a*, 148*b* are approximately equal. The length L4 of the first resilient contact arms 144*a*, 144*b* are approximately equal, but slightly smaller than the length L7 of the fourth resilient contact arms 149*a*, 149*b*. The length L5 of the second resilient contact arms 146*a*, 146*b* and the length L6 of the third resilient contact arms 148*a*, 148*b* are smaller than the length L4 of the first resilient contact arms 144*a*, 144*b* and the length L7 of the fourth resilient contact arms 149*a*, 149*b*. The configuration of the first resilient contact arms 144*a*, 144*b*, the second resilient contact arms 146*a*, 146*b*, the third resilient contact arms 148*a*, 148*b* and the fourth resilient contact arms 149*a*, 149*b* provides the desired normal force for each of the resilient contact arms.

When inserted from the side, the tab is inserted into the tab receiving slot 184 through the free ends of the resilient contact arms 144*a*, 144*b*, 146*a*, 146*b*, 148*a*, 148*b*, 149*a*, 149*b*. As the tab is inserted, the tab engages the lead-in surfaces 158*a*, 158*b*, 168*a*, 168*b*, 178*a*, 178*b*, 179*a*, 179*b* which facilitates the positioning of the tab into the tab receiving slot 184.

With the tab fully inserted from the side, the mating section 116 of the electrical contact 110 is positioned in mechanical and electrical engagement with tab at the contact portions 156*a*, 156*b* of the first resilient contact arms 144*a*, 144*b*, the contact portions 166*a*, 166*b* of the second resilient contact arms 146*a*, 146*b*, the third contact portions 176*a*, 176*b* of the third resilient contact arms 148*a*, 148*b* and the fourth contact portions 177*a*, 177*b* of the fourth contact arms 147*a*, 147*b*. This provides eight points of contact between the electrical contact 110 and the tab, allowing high and even current flow therebetween.

Because of the configuration of the resilient contact arms 144*a*, 144*b*, 146*a*, 146*b*, 148*a*, 148*b*, 149*a*, 149*b*, the normal force applied by the contact portions 156*a*, 156*b* of the first resilient contact arms 144*a*, 144*b* to the tab is essentially equivalent to the normal force applied by the contact portions 166*a*, 166*b* of the second resilient contact arms 146*a*, 146*b*, is essentially equivalent to the normal force applied by the contact portions 176*a*, 176*b* of the third resilient contact arms 148*a*, 148*b*, and is essentially equivalent to the normal force applied by the contact portions 177*a*, 177*b* of the fourth resilient contact arms 149*a*, 149*b*.

In the illustrative embodiment shown, the length L5 of the second resilient contact arms 146*a*, 146*b* and the length L6 of the third resilient contact arms 148*a*, 148*b* are approximately equal. The length L4 of the first resilient contact arms 144*a*, 144*b* are approximately equal, but slightly smaller than the length L7 of the fourth resilient contact arms 149*a*, 149*b*. The length L5 of the second resilient contact arms 146*a*, 146*b* and the length L6 of the third resilient contact arms 148*a*, 148*b* are smaller than the length L4 of the first resilient contact arms 144*a*, 144*b* and the length L7 of the fourth resilient contact arms 149*a*, 149*b*. The configuration of the first resilient contact arms 144*a*, 144*b*, the second resilient contact arms 146*a*, 146*b*, the third resilient contact arms 148*a*, 148*b* and the fourth resilient contact arms 149*a*, 149*b* provides the desired normal force for each of the resilient contact arms.

As the normal force at all points of contact is essentially identical, each of the contact portions 156*a*, 156*b*, 166*a*, 166*b*, 176*a*, 176*b*, 177*a*, 177*b* will have the same amount of wear as the tab is inserted and removed from the electrical contact 110 over many cycles. As the contact portions 156*a*, 156*b*, 166*a*, 166*b*, 176*a*, 176*b*, 177*a*, 177*b* apply the same normal force on the tab and as the contact portions 156*a*, 156*b*, 166*a*, 166*b*, 176*a*, 176*b*, 177*a*, 177*b* will have the same amount of wear, the flow of the electrical current over the life of the electrical contact 110 will remain evenly distributed, as electrical connection between each of the contact portions 156*a*, 156*b*, 166*a*, 166*b*, 176*a*, 176*b*, 177*a*,

177*b* and the tab will remain consistent with the other contact portions 156*a*, 156*b*, 166*a*, 166*b*, 176*a*, 176*b*, 177*a*, 177*b*.

Having multiple contact portions 156*a*, 156*b*, 166*a*, 166*b*, 176*a*, 176*b*, 177*a*, 177*b* with essentially equivalent contact or normal forces allows the current to flow evenly between the contact portions 156*a*, 156*b*, 166*a*, 166*b*, 176*a*, 176*b*, 177*a*, 177*b* and the tab. The even flow of current prevents any one contact portion 156*a*, 156*b*, 166*a*, 166*b*, 176*a*, 176*b*, 177*a*, 177*b* from overheating due to excess current flow. Consequently, the configuration of the resilient contact arms 144*a*, 144*b*, 146*a*, 146*b*, 148*a*, 148*b*, 149*a*, 149*b* to control and make equal the normal force at all points of contact allows for the maximum temperature rise for the contact 110 to be controlled and reduced.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector for receiving a mating tab, the electrical connector comprising:

a mating section for receiving the mating tab therein, the mating section having a first contact arm, a second contact arm and a third contact arm, the first contact arm being spaced from the second contact arm by a first slot, the first contact arm having a first length which is different than a second length of the second contact arm, the third contact arm is spaced from the second contact arm by a second slot, the third contact arm has a third length which is different than the first length of the first contact arm and the second length of the second contact arm, the first slot has a first slot length which is different than the second slot length of the second slot, the mating section has a base section with a mating section first wall, a first mating contact engagement section extends from the mating section first wall, the first mating contact engagement section has the first contact arm, the second contact arm, the third contact arm, the first mating contact engagement section has a first bend portion, a first stabilizing portion, and a first tab engaging portion, the first bend portion extends from and is integral with the mating section first wall;

wherein a first normal force exerted by the first contact arm on the mating tab is equal to a second normal force exerted by the second contact arm, and a third normal force exerted by the third contact arm on the mating tab is equal to the first normal force exerted by the first contact arm and the second normal force exerted by the second contact arm.

2. The electrical connector as recited in claim 1, wherein the mating section has a fourth contact arm, the fourth contact arm is spaced from the third contact arm by a third slot, the fourth contact arm has a fourth length which is different than the first length of the first contact arm, the second length of the second contact arm and the third length of the third contact arm, the third slot has a third slot length which is different than the first slot length of the first slot and the second slot length of the second slot, wherein a fourth normal force exerted by the fourth contact arm on the mating tab is equal to the first normal force exerted by the first contact arm, the second normal force exerted by the second contact arm and the third normal force exerted by the third contact arm.

3. The electrical connector as recited in claim 2, wherein the mating section has a mating section second wall, a second mating contact engagement section extends from the mating section second wall, the second mating contact engagement section has a second first contact arm, a second second contact arm, a second third contact arm and a second fourth contact arm.

4. The electrical connector as recited in claim 3, wherein the mating section second wall which is spaced from the mating section first wall, a mating section third wall extends between the mating section first wall and the mating section second wall.

5. The electrical connector as recited in claim 4, wherein the first mating contact engagement section of the mating section extends from the mating section first wall in a direction away from the mating section third wall.

6. The electrical connector as recited in claim 5, wherein the second mating contact engagement section of the mating section extends from the mating section second wall in a direction away from the mating section third wall, the second contact engagement section has a second bend portion, a second stabilizing portion, and a second tab engaging portion, the second bend portion extends from and is integral with the mating section second wall.

7. The electrical connector as recited in claim 6, wherein the second mating contact engagement section is a mirror image of the first contact engagement section, the first contact arms, the second contact arms and the third contact arms are provided on the first tab engaging portion and the second tab engaging portion.

8. The electrical connector as recited in claim 7, wherein the first contact arms have straight portions, contact portions and lead-in portions, the straight portions extend from the stabilizing portions and have a first length, the lead-in portions are provided at free ends of the first contact arms which are spaced from the stabilizing portions, the contact portions are provided between the straight portions and the lead-in portions, the contact portions have curved configurations.

9. The electrical connector as recited in claim 8, wherein the second contact arms have straight portions, contact portions and lead-in portions, the straight portions extend from the stabilizing portions and have a second length, the lead-in portions are provided at free ends of the second contact arms which are spaced from the stabilizing portions, the contact portions are provided between the straight portions and the lead-in portions, the contact portions have curved configurations.

10. The electrical connector as recited in claim 9, wherein the third contact arms have straight portions, contact portions and lead-in portions, the straight portions extend from the stabilizing portions and have a third length, the lead-in portions are provided at free ends of the third contact arms which are spaced from the stabilizing portions, the contact portions are provided between the straight portions and the lead-in portions, the contact portions have curved configurations.

11. The electrical connector as recited in claim 10, wherein a tab receiving slot extends between the first wall and the second wall of the base section and continues between the first mating contact engagement section and the second mating contact engagement section.

12. The electrical connector as recited in claim 11, wherein the tab receiving slot has a lead-in surface which extends from a mating surface of the mating section, the lead-in surface extends across the base section, the first mating contact engagement section and the second mating contact engagement section.

13. The electrical connector as recited in claim 12, wherein a mounting section extends from the mating section, the mounting section has a substrate engagement surface with mounting legs which extend therefrom in a direction away from the mating section.

14. An electrical connector for receiving a mating tab from multiple directions, the electrical connector comprising:

a mounting section for mounting to a substrate or a mating connector;

a mating section for receiving the mating tab therein, the mating section having a base section with a first wall and a second wall, a first mating contact engagement section extending from the first wall and a second mating contact engagement section extending from the second wall;

the first mating contact engagement section and the second mating contact engagement section having contact arms with first lead-in surfaces provided at free ends thereof;

a tab receiving slot extending between the first wall and the second wall of the base section and continuing between the first mating contact engagement section and the second mating contact engagement section;

a second lead-in surface extending from a mating surface of the mating section, the second lead-in surface extending across the base section, the first mating contact engagement section and the second mating contact engagement section;

wherein the first lead-in surfaces and the second lead-in surface allows the mating tab to be inserted into the tab receiving slot from multiple directions.

15. The electrical connector as recited in claim 14, wherein the second mating contact engagement section is a mirror image of the first mating contact engagement section.

16. The electrical connector as recited in claim 15, wherein the first mating contact engagement section and the second mating contact engagement section having first contact arms and second contact arms, the first contact arms spaced from the second contact arms by first slots, the first contact arms having a first length which is different than a second length of the second contact arms, wherein a first normal force exerted by the first contact arms on the mating tab is equal to a second normal force exerted by the second contact arms.

17. The electrical connector as recited in claim 16, wherein the first mating contact engagement section and the second mating contact engagement section having third contact arms, the second contact arms are spaced from the third contact arms by second slots, the third contact arms have a third length which is different than the first length of the first contact arms and the second length of the second contact arms, the first slot has a first slot length which is different than the second slot length of the second slot, wherein a third normal force exerted by the third contact arms on the mating tab is equal to the first normal force exerted by the first contact arms and the second normal force exerted by the second contact arms.

18. The electrical connector as recited in claim 16, wherein the first contact arms have straight portions, contact portions and lead-in portions, the straight portions extend from the stabilizing portions and have a first length, the lead-in portions are provided at free ends of the first contact arms which are spaced from the stabilizing portions, the contact portions are provided between the straight portions and the lead-in portions, the contact portions have curved configurations.

19. The electrical connector as recited in claim 18, wherein the second contact arms have straight portions, contact portions and lead-in portions, the straight portions extend from the stabilizing portions and have a second length, the lead-in portions are provided at free ends of the second contact arms which are spaced from the stabilizing portions, the contact portions are provided between the straight portions and the lead-in portions, the contact portions have curved configurations.

* * * * *